US009149139B1

(12) United States Patent
Rogers et al.

(10) Patent No.: US 9,149,139 B1
(45) Date of Patent: Oct. 6, 2015

(54) INSULATED FLOATING BEVERAGE HOLDER WITH WEIGHTED BOTTOM

(71) Applicants: Michael Rogers, Jacksonville, FL (US); Catherine Rogers, Jacksonville, FL (US)

(72) Inventors: Michael Rogers, Jacksonville, FL (US); Catherine Rogers, Jacksonville, FL (US)

( * ) Notice: Subject to any disclaimer, the term of this patent is extended or adjusted under 35 U.S.C. 154(b) by 0 days.

(21) Appl. No.: 14/504,486

(22) Filed: Oct. 2, 2014

(51) Int. Cl.

| | |
|---|---|
| ***B65D 88/78*** | (2006.01) |
| ***A47G 23/02*** | (2006.01) |
| ***B65D 81/38*** | (2006.01) |
| ***E04H 4/14*** | (2006.01) |
| ***B63B 35/73*** | (2006.01) |

(52) U.S. Cl.
CPC ..... *A47G 23/02* (2013.01); *B63B 35/73* (2013.01); *B65D 81/3876* (2013.01); *E04H 4/14* (2013.01); *A47G 2023/0275* (2013.01)

(58) Field of Classification Search
CPC ..... A47G 23/02; A47G 2023/0275; A47G 2200/02; E04H 4/14; B65D 81/3876; B63B 35/73
USPC ..... 220/560
See application file for complete search history.

(56) References Cited

U.S. PATENT DOCUMENTS

| | | | | |
|---|---|---|---|---|
| 1,703,759 | A * | 2/1929 | Ament | 215/228 |
| 2005/0279751 | A1* | 12/2005 | Dempsey | 220/739 |
| 2006/0091141 | A1* | 5/2006 | Scott | 220/560 |

* cited by examiner

*Primary Examiner* — Fenn Mathew
*Assistant Examiner* — Elizabeth Volz
(74) *Attorney, Agent, or Firm* — Lawrence J. Gibney, Jr.; Mitch Ghaneie

(57) ABSTRACT

This device holds a beverage afloat in an upright position in the water at all times while the beverage is being consumed. This is accomplished by placing a flotation ring around the outer surface of the beverage holder and a weight at the bottom for stability. The device additionally provides a piercing rod for prying open a tab on an aluminum can or puncturing an aluminum can, a bottle opener for opening a different type of beverage and a lanyard and lanyard ring as well as a pouch for litter.

6 Claims, 4 Drawing Sheets

INSULATED FLOATING BEVERAGE HOLDER WITH WEIGHTED BOTTOM

BACKGROUND OF THE INVENTION

A. Field of the Invention

The present invention relates to the insulating, opening, floating, and securing a beverage in a body of water so that the beverage remains upright at all times.

B. Prior Art

Many are challenged with the dilemma of drinking a beverage while in a body of water and having no place to set one's drink. If in a pool and holding a beverage, one typically only has one hand to participate in recreational activities. However, the invention disclosed in this application enables one to stably float the beverage in an upright position in the water so that it does not spill.

Scott, U.S. Patent Publication Number 2006/0091141, describes a ring that helps float a beverage. It additionally describes the use of a weight at the bottom that purely serves to stabilize the holder.

Sebastian, U.S. Pat. No. 7,685,908, describes an insulated drink holder that has a bottle opener affixed to the bottom of the holder.

The presented device allows a person to place a beverage in an insulated drink holder that floats but will also allow the beverage to remain upright in the water during the entire time due to a weight that has been added near the bottom surface. In order to make this as user friendly as possible a bottle opener has been placed on the holder as well as a piercing rod. The piercing rod is placed in order to quickly drain the contents of the can, if desired.

Furthermore, in order to insure that the beverage remains near the person while drinking, a ring has been affixed to the beverage holder. The user can tie a lanyard to his or her person or flotation device that may be used and attach the other end of the lanyard to the ring.

While there are other prior art references as described above there was no prior art found that utilized all the novel and innovative features disclosed in this application.

BRIEF SUMMARY OF THE INVENTION

This device is an insulated beverage holder that includes a floatation ring, weights to stabilize the device while floating, a lanyard ring, a lanyard, a flip-out bottle opener, a flip-out piercing rod, and a place to hold one's bottle cap after the bottle is opened. This device may be used to hold an aluminum can or a glass bottle or a plastic cup.

The floatation ring is placed on the upper half of the holder and the metal weighted insert is placed on the lower half of the holder for stabilization. The piercing rod and bottle opener may be flipped-out for use and folded in while not used. When each of them are folded in the beverage holder can sit evenly on a flat surface.

The presented device allows one to place a beverage in an insulated drink holder that floats and has a bottle opener located on the bottom of the holder and a piercing rod that is also located on the bottom of the holder that can be used to puncture through the metal of the lower portion of an aluminum can or pull a tab to open an aluminum can. The use of the piercing rod will allow the user to quickly drain the contents of the can, if desired.

Furthermore, after drinking some beverages the user often becomes distracted and forgets the location of the beverage holder. In order to solve this problem, a ring has been affixed to the beverage holder. The user can tie a lanyard to his or her person or flotation device and attach the other end of the lanyard to the ring.

A pocket is provided on the side of the insulated cooler to place the top or tab from the bottle or can so that it is not discarded on the ground.

NUMBERING REFERENCE

Figure 1:
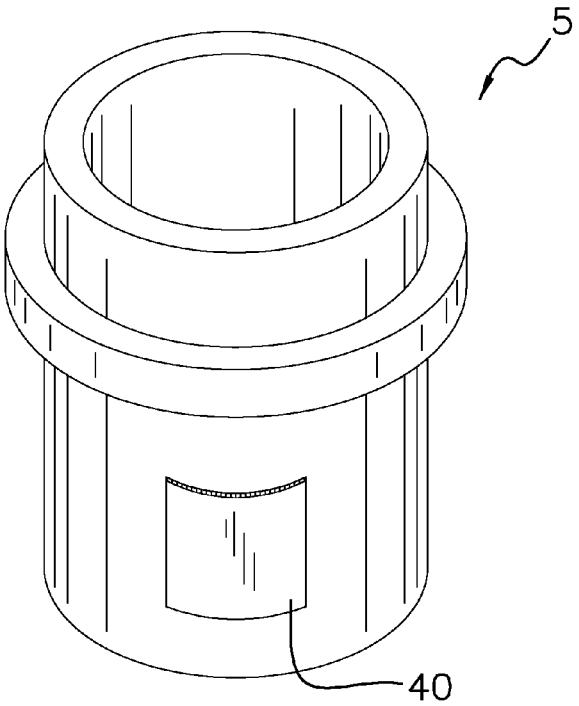
FIG. 1 is a top isometric view of the device.
Figure 2:
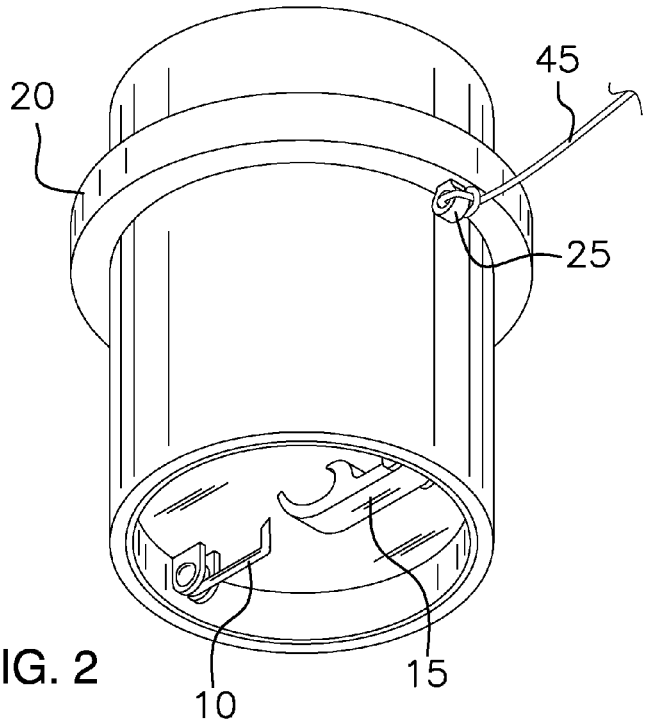
FIG. 2 is a bottom isometric view of the device.
Figure 3:
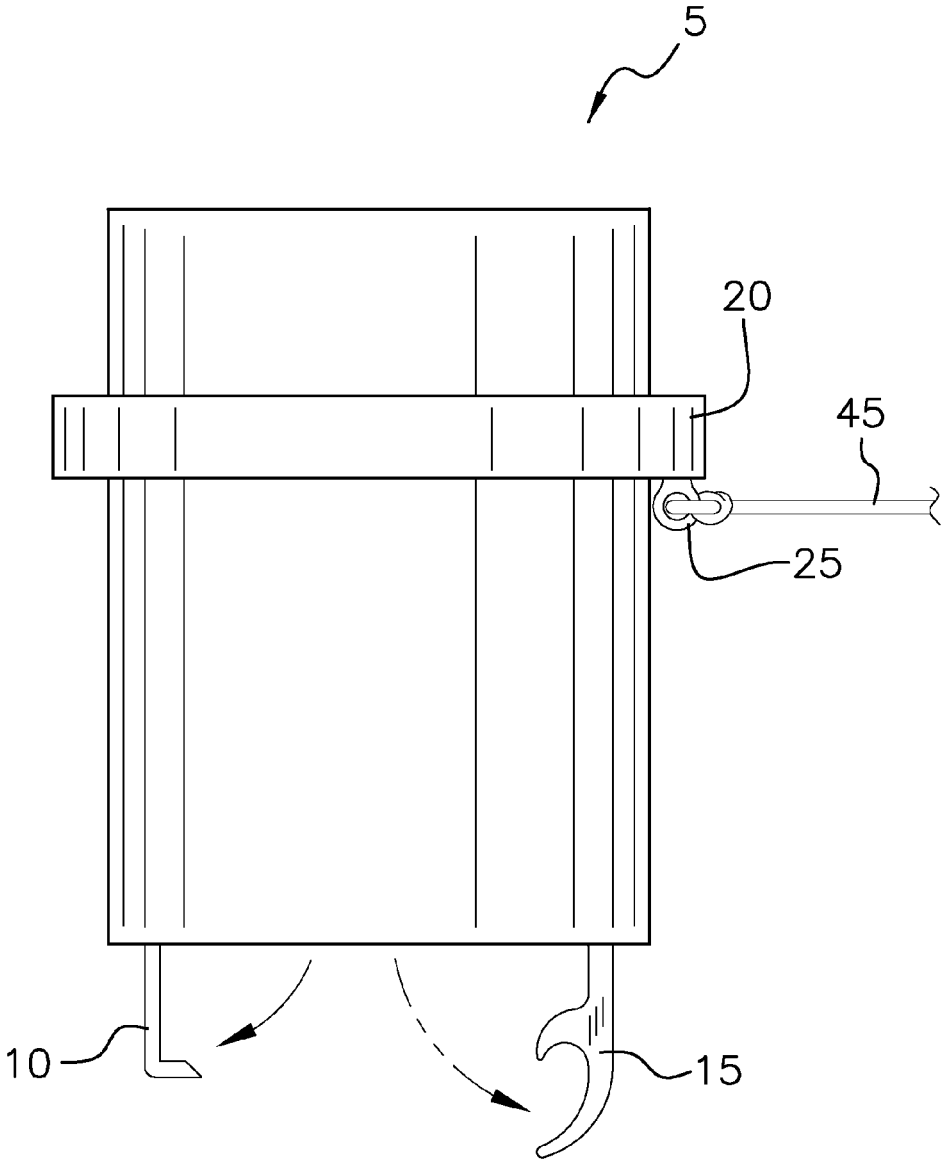
FIG. 3 is a side view of the device.
Figure 4:
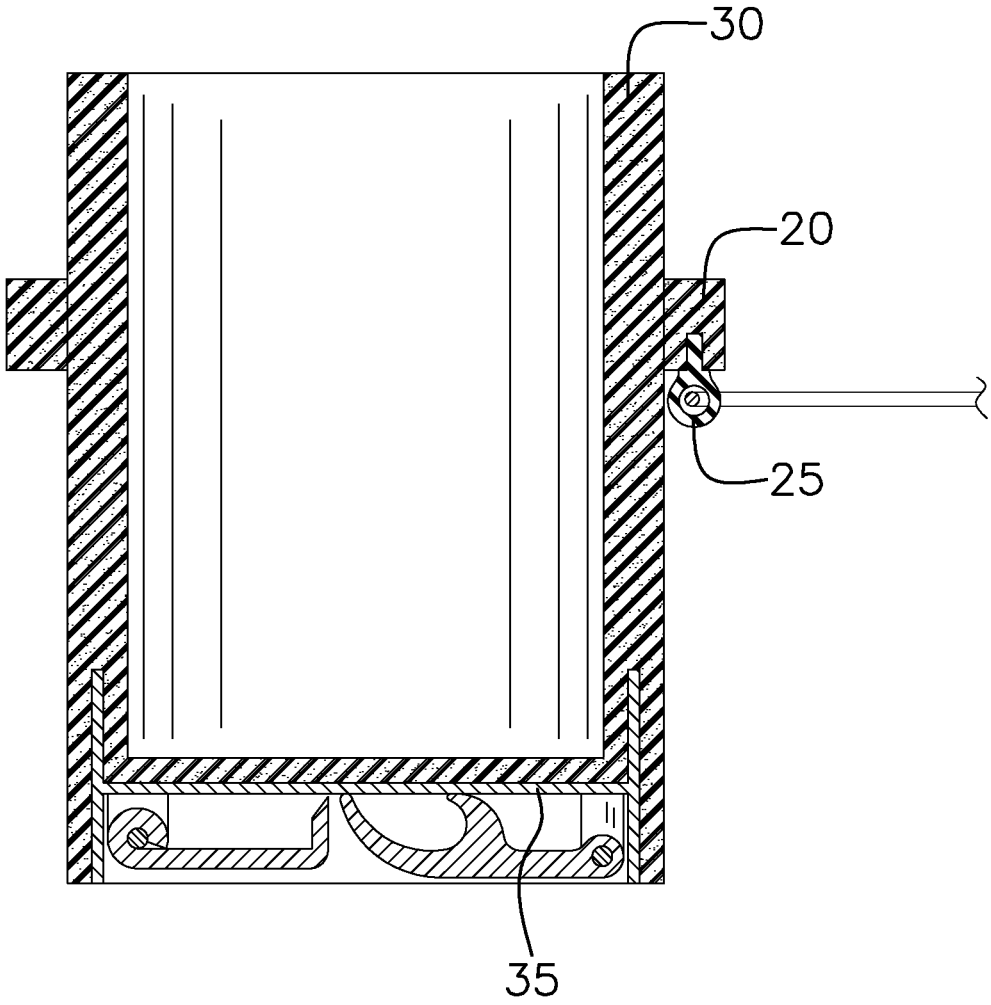
FIG. 4 is a cross-section view of the device.

5—Device
10—Piercing Rod
15—Bottle Opener
20—Flotation Ring
25—Lanyard Ring
30—Insulating Material
35—Metal Insert
40—Pocket
45—Lanyard

DETAILED DESCRIPTION OF THE EMBODIMENTS

The insulated beverage holder with weighted bottom will be used to float a beverage in the water. With this device the beverage will remain upright during the entire time that the beverage is being consumed. For the purposes of this application the beverage will be an aluminum can. However, it is contemplated that the device can be modified to accommodate a glass bottle or plastic cup.

The beverage holder is comprised of an insulated material 30, a flotation ring 20, a lanyard ring 25, a lanyard 45, a metal insert 35, a flip-out piercing rod 10, a flip-out bottle opener 15, and a pocket 40.

The beverage is placed in the center of the device and the bottom of the beverage rests against the top surface of the bottom surface. As each beverage is consumed the beverage is removed from the device and a new beverage is placed in the device.

The beverage holder contains insulated material 30 to keep the beverage cold or possibly warm depending on the type of beverage. The beverage holder will also hold the aluminum can, glass bottle or plastic cup.

The flotation ring 20 will be wrapped around the upper portion of the insulated material 30. This will help the beverage holder resist tipping over while floating. The flotation ring may be affixed to the beverage holder or may be positioned at a desired location on the beverage holder.

The metal insert 35 that is placed near the bottom surface of the beverage holder will insure that the beverage holder remains upright during the entire time that the beverage is being consumed.

On the bottom surface the metal insert 35 will also provide a rigid surface to connect the flip-out bottle opener 15 and flip-out piercing rod 10. The metal insert 35, bottle opener 15, and piercing rod 10 are also intended to provide added weight by being placed on the bottom of the device. The metal insert 35 is slightly recessed so that when the bottle opener 15 and piercing rod 10 are folded against the metal insert the beverage holder can rest on a flat surface.

The flip-out piercing rod 10 will allow the user to pierce an aluminum can. The can may be pierced or punctured in the top portion or the bottom portion of the can. By puncturing the can it allows air to enter the hole created by the piercing rod 10. When the tab on top of the can is pulled almost immediately after the puncturing of the can, the user can drink the contents of the beverage quicker.

Some cans sold today are manufactured to allow a hole to be punctured in the top of the can near the tab. The flip-out piercing rod 10 is capable of being used there as well although not depicted in the Figures in that position. After the piercing rod 10 is used it may be folded towards the recessed metal insert, thereby concealing it and again allowing the beverage holder to rest on a flat surface.

The flip-out bottle opener 15 is located on the bottom of the device and is attached to the recessed metal insert 35. The bottle opener may be used to open bottles that require a bottle opener, or on bottles that utilize twist off bottle caps. If one desires to use the flip-out bottle opener then the user can pull the bottle opener 15 out and utilize it for opening a bottle. Once finished with opening a bottle, the user may fold the bottle opener 15 back under the device, thereby concealing it.

In order to prevent the beverage holder from floating away from the user of the product a lanyard ring 25 is attached to the flotation ring for the purposes of this application. However, the lanyard ring 25 is not restricted to being attached to only the flotation ring 20. The ring 25 is used to attach the device to the user or a flotation device that is being used by the user. However, this device provides the user with a lanyard 45 that has two ends. The first end will be tied to the ring 25. The second end of the lanyard 45 will be tied to the person using the device 5. This will help the user ensure that the device 5 is always by his or her side. The length of the lanyard may be adjustable by the user.

ALTERNATIVE EMBODIMENT

In the prior embodiment the use of the device with an aluminum can was described. The alternative embodiment describes how the device can be used with a glass or plastic bottle.

Figure 5:
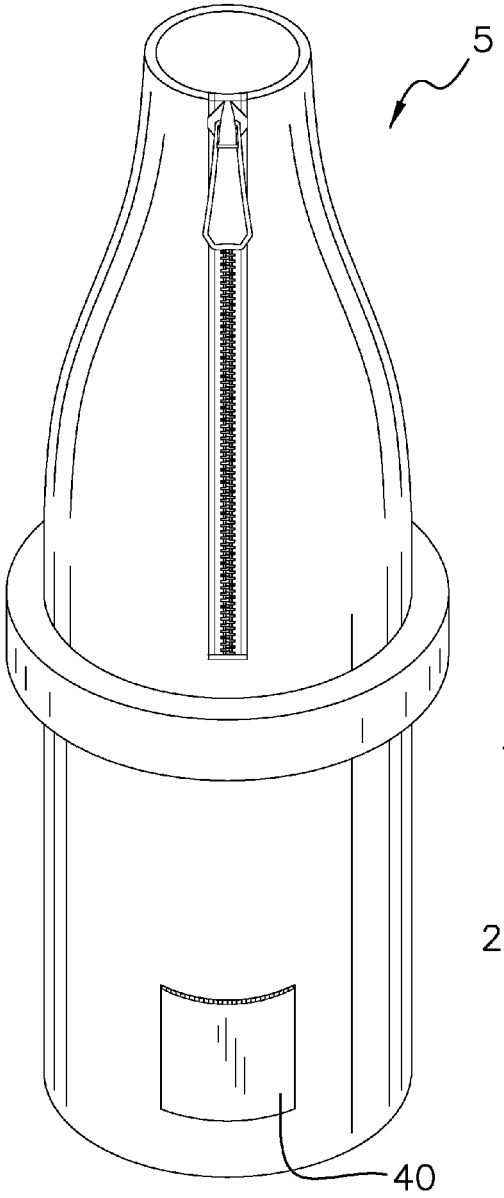
FIG. 5 is a front isometric view of an alternative embodiment.
Figure 6:
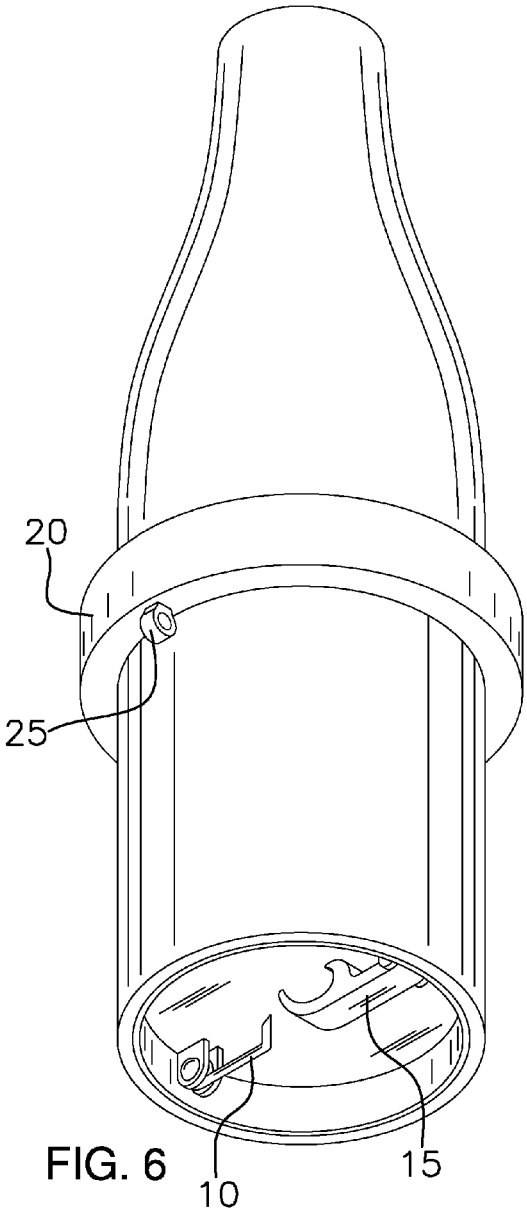
FIG. 6 is a bottom isometric view of an alternative embodiment.

In this alternative embodiment the beverage holder such as shown in FIGS. 5 and 6 is comprised of a tapered neck into which the bottle will fit. A zipper as shown is typically used to allow the bottle to easily be removed when empty.

The central idea of the flotation ring and weighted bottom with can opener and piercing rod remains the same in this embodiment.

While the embodiments of the invention have been disclosed, certain modifications may be made by those skilled in the art to modify the invention without departing from the spirit of the invention.

The invention claimed is:

1. A beverage holder which is comprised of:
   a. a holder of predetermined size;
      said holder has a top surface and a bottom surface;
      wherein a recessed portion on the bottom surface is provided;
      wherein the recessed portion is a predetermined shape;
      wherein a beverage is placed in the device;
      said beverage rests against the interior surface of the bottom surface of the device;
      said beverage is contained in an aluminum can;
   b. a weighted bottom;
      wherein a weight is placed in the beverage holder on the bottom surface;
   c. insulating material;
      wherein a layer of insulating material is placed on the interior of the beverage holder;
   d. a flotation ring;
      wherein the flotation ring is affixed to the beverage holder;
   e. a metal insert;
      wherein the metal insert is affixed to the bottom surface of the beverage holder;
      wherein the metal insert is recessed into the bottom surface of the beverage holder;
   f. a piercing rod;
      wherein the piercing rod is affixed to the metal insert;
      wherein the piercing rod folds out;
      wherein the piercing rod can puncture a hole in a beverage container;
      wherein the piercing rod can puncture an aluminum can that is placed in the device;
      wherein the piercing rod is placed in the recessed portion;
   g. a bottle opener;
      wherein the bottle opener is affixed to the metal insert;
      wherein the bottle opener folds out;
      wherein the bottle opener can open bottles with twist off caps;
      wherein the bottle opener is placed in the recessed portion;
   h. a lanyard ring;
      wherein the lanyard ring is attached to the flotation ring;
   i. a lanyard;
      wherein the lanyard has a first end and a second end;
      wherein said first end of the lanyard is attached to the lanyard ring;
      wherein said second end of the lanyard is adapted to a person using the device;
   j. a pocket;
      said pocket is placed on the outside surface of the beverage holder;
      wherein the pocket is large enough to hold a bottle cap or tab.

2. The device as described in claim 1 wherein the position of the flotation ring can be adjusted.

3. A beverage holder which is comprised of:
   a. a holder of predetermined size;
      said holder has a top surface and a bottom surface;
      wherein a recessed portion on the bottom surface is provided;
      wherein the recessed portion is a predetermined shape;
      wherein a beverage is placed in the device;
      said beverage rests against the interior surface of the bottom surface of the device;
      wherein the beverage is contained in a glass bottle;
   b. a weighted bottom;
      wherein a weight is placed in the beverage holder on the bottom surface;
   c. insulating material;
      wherein a layer of insulating material is placed on the interior of the beverage holder;
   d. a flotation ring;
      wherein the flotation ring is affixed to the beverage holder;
   e. a metal insert;
      wherein the metal insert is affixed to the bottom surface of the beverage holder;

wherein the metal insert is recessed into the bottom surface of the beverage holder;

f. a piercing rod;

wherein the piercing rod is affixed to the metal insert;

wherein the piercing rod folds out;

wherein the piercing rod is placed in the recessed portion;

g. a bottle opener;

wherein the bottle opener is affixed to the metal insert;

wherein the bottle opener folds out;

wherein the bottle opener can open bottles with twist off caps;

wherein the bottle opener is placed in the recessed portion;

h. a lanyard ring;

wherein the lanyard ring is attached to the flotation ring;

i. a lanyard;

wherein the lanyard has a first end and a second end;

wherein said first end of the lanyard is attached to the lanyard ring;

wherein said second end of the lanyard is adapted to a person using the device;

j. a pocket;

said pocket is placed on the outside surface of the beverage holder;

wherein the pocket is large enough to hold a bottle cap or tab.

4. The device as described in claim 3 wherein the position of the flotation ring can be adjusted.

5. A beverage holder which is comprised of:

a. a holder of predetermined size;

said holder has a top surface and a bottom surface;

wherein a recessed portion on the bottom surface is provided;

wherein the recessed portion is a predetermined shape;

wherein a beverage is placed in the device;

said beverage rests against the interior surface of the bottom surface of the device;

wherein the beverage is contained in a plastic cup;

b. a weighted bottom;

wherein a weight is placed in the beverage holder on the bottom surface;

c. insulating material;

wherein a layer of insulating material is placed on the interior of the beverage holder;

d. a flotation ring;

wherein the flotation ring is affixed to the beverage holder;

e. a metal insert;

wherein the metal insert is affixed to the bottom surface of the beverage holder;

wherein the metal insert is recessed into the bottom surface of the beverage holder;

f. a piercing rod;

wherein the piercing rod is affixed to the metal insert;

wherein the piercing rod folds out;

wherein the piercing rod is placed in the recessed portion;

g. a bottle opener;

wherein the bottle opener is affixed to the metal insert;

wherein the bottle opener folds out;

wherein the bottle opener can open bottles with twist off caps;

wherein the bottle opener is placed in the recessed portion;

h. a lanyard ring;

wherein the lanyard ring is attached to the flotation ring;

i. a lanyard;

wherein the lanyard has a first end and a second end;

wherein said first end of the lanyard is attached to the lanyard ring;

wherein said second end of the lanyard is adapted to a person using the device;

j. a pocket;

said pocket is placed on the outside surface of the beverage holder;

wherein the pocket is large enough to hold a bottle cap or tab.

6. The device as described in claim 5 wherein the position of the flotation ring can be adjusted.

* * * * *